US010538106B2

(12) United States Patent
Stritzel

(10) Patent No.: US 10,538,106 B2
(45) Date of Patent: Jan. 21, 2020

(54) METHOD FOR COMPENSATING FOR DEFECTIVE PRINTING NOZZLES IN INKJET PRINTING

(71) Applicant: HEIDELBERGER DRUCKMASCHINEN AG, Heidelberg (DE)

(72) Inventor: Bernd Stritzel, Goosefeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 114 days.

(21) Appl. No.: 15/902,339

(22) Filed: Feb. 22, 2018

(65) Prior Publication Data

US 2018/0264839 A1 Sep. 20, 2018

(30) Foreign Application Priority Data

Mar. 15, 2017 (DE) ..... 10 2017 204 320

(51) Int. Cl.
*B41J 2/21* (2006.01)
*B41J 2/155* (2006.01)
*B41J 2/205* (2006.01)

(52) U.S. Cl.
CPC ..... *B41J 2/2139* (2013.01); *B41J 2/155* (2013.01); *B41J 2/2054* (2013.01)

(58) Field of Classification Search
CPC ..... B41J 2/0451; B41J 2/2139; B41J 2/2142; B41J 2/16579; B41J 2002/165
See application file for complete search history.

(56) References Cited

U.S. PATENT DOCUMENTS

| | | | | |
|---|---|---|---|---|
| 6,010,205 | A | 1/2000 | Billet | |
| 6,830,306 | B2 | 12/2004 | Couwenhoven et al. | |
| 7,168,782 | B2 | 1/2007 | Koitabashi et al. | |
| 9,227,424 | B1 * | 1/2016 | Mantell | B29C 64/112 |
| 9,375,964 | B2 | 6/2016 | Koehler et al. | |
| 2004/0119766 | A1 | 6/2004 | Shibata et al. | |
| 2005/0146543 | A1 * | 7/2005 | Smith | B41J 2/04508 347/6 |
| 2006/0109294 | A1 * | 5/2006 | Garcia-Reyero | B41J 2/2139 347/15 |
| 2006/0170721 | A1 | 8/2006 | Takahashi | |
| 2006/0244774 | A1 | 11/2006 | Arazaki et al. | |

(Continued)

FOREIGN PATENT DOCUMENTS

| | | | |
|---|---|---|---|
| DE | 602004004829 | T2 | 10/2007 |
| DE | 60132042 | T2 | 12/2008 |
| EP | 1732306 | A1 | 12/2006 |

*Primary Examiner* — Julian D Huffman
(74) *Attorney, Agent, or Firm* — Laurence A. Greenberg; Werner H. Stemer; Ralph E. Locher

(57) ABSTRACT

A method for carrying out a printing operation on an inkjet printing machine compensates for failed printing nozzles by using a computer. After a screening process in which a halftone image is created for an image to be printed, failed printing nozzles are compensated for by increased ink application from neighboring printing nozzles by precalculating at least one corrective halftone image for the adjacent printing nozzles by using the computer, replacing the halftone image created in the screening process by the corrective halftone image in the at least one column of the neighboring printing nozzles, and carrying out the printing operation on the inkjet printing machine using the corrected halftone.

5 Claims, 7 Drawing Sheets

(56) References Cited

U.S. PATENT DOCUMENTS

| | | | | |
|---|---|---|---|---|
| 2011/0090276 | A1 | 4/2011 | Hirano | |
| 2013/0070009 | A1 | 3/2013 | Yoshida | |
| 2014/0139581 | A1* | 5/2014 | Gerrits | B41J 2/2139 347/14 |
| 2015/0138265 | A1* | 5/2015 | Ito | B41J 2/04581 347/10 |
| 2015/0202876 | A1 | 7/2015 | Tamai | |
| 2015/0210100 | A1* | 7/2015 | Hayashi | B41J 29/393 347/19 |
| 2016/0052300 | A1* | 2/2016 | Ueshima | B41J 2/205 347/16 |
| 2017/0157920 | A1* | 6/2017 | Taniyama | B41J 2/04541 |
| 2017/0165964 | A1* | 6/2017 | Misawa | B41J 2/04541 |
| 2018/0022112 | A1* | 1/2018 | Billow | B41J 2/0451 347/47 |
| 2018/0096472 | A1* | 4/2018 | Ukishima | H04N 1/6041 |
| 2019/0224964 | A1* | 7/2019 | Mizutani | B41J 2/2142 |

* cited by examiner

METHOD FOR COMPENSATING FOR DEFECTIVE PRINTING NOZZLES IN INKJET PRINTING

CROSS-REFERENCE TO RELATED APPLICATION

This application claims the benefit, under 35 U.S.C. § 119, of German Patent Application DE 10 2017 204 320.2, filed Mar. 15, 2017; the prior application is herewith incorporated by reference in its entirety.

BACKGROUND OF THE INVENTION

Field of the Invention

The present invention relates to a method for carrying out a printing operation on an inkjet printing machine while correcting missing nozzles by using precalculated corrective halftone images.

The technical field of the invention is the field of digital printing.

In inkjet printing, the failure of individual printing nozzles in the print head of an inkjet printing machine is a common problem. Such failures of individual printing nozzles may have various causes. Apart from general malfunctions for instance in the ink supply to the individual printing nozzle in question, blockages of a printing nozzle are frequent causes for problems. In addition, printing nozzles that print at an angle, i.e. a print dot that is shifted sideways, are a common problem. Such printing nozzles that print at an angle are also referred to as defective. The result of a failed nozzle on the printed image is a so-called white line. That means that places to which ink should be applied in the printed image do not receive any ink in the printing direction because the relevant printing nozzle has failed, whereas the neighboring printing nozzles, which are not defective, continue to apply ink in the appropriate way. As a consequence, the printing material shines through along a line in the printing direction. That is known as a white line. In multicolor printing, it results in distorted colors. In printing nozzles that print at an angle, for instance because of dried-on ink residues at the nozzle opening, an additional defect known as a black line is created next to the white line as a function of the degree of deflection of the ink jet of the printing nozzle in question. That is caused by the fact that the printing nozzle that prints at an angle prints into the printing region of a functioning neighboring nozzle, causing double ink application or at least increased ink application at that location. In addition to too little ink at the intended printing location of the defective printing nozzle, too much ink is applied at the location where the printing nozzle that prints at an angle actually prints.

Various approaches to correcting such defects caused by defective printing nozzles are known in the art. The most common approach to compensating for failed printing nozzles is to increase the application of ink by the adjacent nozzles in a corresponding way to compensate for the resultant white line. The additional ink that is applied runs from the location of the adjacent printing nozzles into the printing region of the missing printing nozzle and covers the region that was left white with ink. In the prior art, printing nozzles that print at an angle are usually compensated for by being switched off and compensating for them as if they were missing nozzles.

However, that compensation process has a number of disadvantages. Firstly it may only be used to a very limited extent. For instance, if several neighboring printing nozzles fail, the resultant white line is too wide to be completely covered. Another important disadvantage is that compensating for missing printing nozzles by an increased application of ink by using the neighboring printing nozzles will always run the risk of applying too much ink, thus creating a corresponding black line. That is a problem in particular in corresponding solid areas of the print image to be printed where such a black line is particularly conspicuous.

Moreover, since inkjet printing, like standard lithographic offset printing, uses halftone print images, increasing the amount of ink applied by neighboring nozzles furthermore causes changes in the structure of the screened image. When a halftone image changes, for instance to a higher or lower gray value, specific rules have to be observed. For instance, when the gray value is increased, no pixel that was present in the halftone of the lower gray value must be removed or reduced in terms of its ink volume. The same applies vice versa when the gray values are reduced. If these rules are violated, the result is a mottled printed image. The prior art approach to compensating for defective printing nozzles by increasing the ink application of neighboring printing nozzles is in general implemented after the screening process of the print image and may thus result in such a mottled printed image.

However, another known approach of the prior art is to use neighboring nozzles to compensate for a missing printing nozzle by increasing the gray values in the vicinity of the location of the defective printing nozzle before the screening process in a corresponding way and re-screening the print image. That process of course respects the screening rules. However, since in general a missing printing nozzle is only detected in the course of the printing operation, the above process will always require a re-screening of the print image. That re-screening involves a corresponding effort, and while it takes place, the print job needs to be interrupted.

Further approaches are known from the prior art. U.S. Patent Application Publication 2015 020 2876 A1, for instance, describes a printing method and a printing control device in which to compensate for missing printing nozzles, the missing printing nozzle is identified in the printed image, a data generation unit causes all print image data to be associated with specific printing nozzles and a data correction unit allocates the print image data to the printing nozzles in such a way that a failed printing nozzle is assigned to image regions in which as little as possible is to be printed. Thus the print image is adapted in a corresponding way, which accordingly requires a re-screening of the print image.

Another approach to a solution is disclosed in U.S. Pat. No. 6,010,205 A, which proposes a method for inkjet printing wherein missing nozzles are replaced by functioning printing nozzles that are not needed in the current printing operation.

Another approach is known from U.S. Pat. No. 9,375,964 B2. In that case a potential overcompensation resulting from the fact that the neighboring printing nozzles apply too much ink is prevented by the use of random tables for the halftone values of the neighboring printing nozzles. In that context the increased halftone values that describe the increased application of ink of the neighboring printing nozzles are randomly distributed in accordance with a probability dependent on the desired compensatory effect. For instance, for a desired compensation probability P=0.8, the distribution of the increased halftone pixel values are randomly distributed at the corresponding probability of 0.8. That is a way of preventing mottling in the printed image by introducing a random element. The random distribution of the compensation by neighboring printing nozzles reduces the occurrence of systematic structures that catch the eye of an observer. However, a disadvantage of that method is that to avoid overcompensation, the compensation probability will always have to be adapted to the respective current print image. In addition, the disadvantages of manipulating a halftone image that has already been created become relevant since they may still result in a mottled print image.

SUMMARY OF THE INVENTION

It is accordingly an object of the invention to provide a method for compensating for defective printing nozzles in inkjet printing, which overcomes the hereinafore-mentioned disadvantages of the heretofore-known methods of this general type with greater efficiency than the known methods of the prior art and without any negative influence on the printed image.

With the foregoing and other objects in view there is provided, in accordance with the invention, a method for carrying out a printing operation on an inkjet printing machine while compensating for failed printing nozzles by using a computer, wherein after a screening process in which a halftone image is created for an image to be printed, failed printing nozzles are compensated for by increased ink application by neighboring printing nozzles. The method includes the steps of precalculating at least one corrective halftone image for the adjacent printing nozzles by using the computer, replacing the halftone image created in the screening process with the corrective halftone image in the at least one column of the neighboring printing nozzle, and carrying out the printing operation on the inkjet printing machine using the corrected halftone.

The main aspect of the method of the invention is the precalculation of a corrective halftone. This corrective halftone implements increased ink application to compensate for the failed nozzles. The corrective halftone image may be generated in addition to the actual halftone print image as a function of the print image data. However, it is also conceivable to use one or more default corrective halftone images. In this case the corrective halftone image that matches the respective print image needs to be selected in a corresponding way. This may be done during the screening process at the preprint stage. In both cases—precalculation and selection of a corrective halftone image—care needs to be taken to respect the corresponding screening rules. The selected corrective halftone is then applied instead of the original halftone to at least one column of the neighboring printing nozzle to compensate for the failed printing nozzle by increased ink application in the corrective halftone. Due to the fact that the corrective halftone has been precalculated, the only thing that remains to be done when a printing nozzle fails is to replace the original halftone with the corrective halftone at the location of the neighboring printing nozzles. Thus recalculation of the halftone is no longer necessary. If the corrective halftone has in addition been generated in accordance with the screening rules, no additional structures are introduced that have a corresponding negative influence on the halftone image. Then the printing operation may be continued using the halftone image that has been corrected in this way.

A central further development of the method of the invention is that at least two columns of the neighboring printing nozzles both to the left and to the right of the failed printing nozzle in the halftone image as viewed in the printing direction are replaced by at least two different precalculated corrective halftone images. In this process, the halftone image for the columns that are immediately adjacent in a first plane are replaced by a first corrective halftone image whereas the respective neighboring columns that are one column farther away are replaced by a second precalculated corrective halftone image. It is also possible to use more than two corrective halftone images. This is dependent on the correction width one wants to apply to correct the failed printing nozzle. For instance, a correction width of 5 means that the two neighboring printing nozzles to the left and to the right are replaced by corresponding precalculated corrective halftone images. Another possibility is that the first corrective halftone does not only replace the immediately neighboring print columns but the first two neighboring print columns to the left and to the right, for instance. The second halftone screen is then used for the corresponding print columns that are farther away. The number of print columns per corrective halftone may be freely chosen as a function of the requirements. It is even possible—although not always expedient—to mix the at least two corrective halftones. This means that, for instance, the first corrective halftone is used for the first two immediately neighboring print columns, the second corrective halftone is used for the third print column, and the first corrective halftone is used again for the fourth print column, etc.

Another preferred development of the method of the invention is that both to the left and to the right of the missing printing nozzle as viewed in the printing direction the at least one column that is immediately adjacent the failed printing nozzle compensates for the missing printing nozzle by using at least one first corrective halftone image with increased ink application, whereas the at least one column that is farther away from the failed printing nozzle prevents potential overcompensation by using at least one second corrective halftone image with reduced ink application. The first corrective halftone image with increased ink application is used to compensate for the failed printing nozzle. The point of a second corrective halftone image or rather of using different corrective halftone images in general is that the second corrective halftone image has reduced ink application to counteract any potential overcompensation that may be caused by the increased ink application of the first corrective halftone image. This ensures that the compensation does not introduce new defects in the printed image.

A further preferred development of the method of the invention is that for missing printing nozzles that have a deviating print dot and for missing printing nozzles that do not print at all or print to a very reduced extent, respective precalculated corrective halftone images are used that have been adapted in a suitable way. After all it makes sense to use specific precalculated corrective halftone images that have been adapted in a corresponding way for printing nozzles that print at an angle. In this context, it is especially the use of corrective halftone images with reduced ink application that is of greater importance because in this way the ink that continues to be present, albeit at the wrong location, may be compensated for. This is an alternative to the prior art approach of deactivating printing nozzles that print at an angle and to compensate for them as missing printing nozzles.

An added preferred development of the method of the invention is that the columns positioned to the left and to the right, respectively, of the missing printing nozzle as viewed in the printing direction carry out the compensation using different precalculated corrective halftone images. Even in cases that do not involve printing nozzles that print at an angle the use of different corrective halftones for the print columns to the left and those to the right of the defective printing nozzle may make sense. One such case is, for instance, if the regions to the left and those to the right in the printed image have different structures for which different corrective halftone images that are suitable in a corresponding way make sense. What needs to be considered, however, is the fact that the more corrective halftone images are precalculated for the correction process, the greater the overall effort the method of the invention requires. A careful analysis of effort and benefits needs to be made.

An additional preferred development of the method of the invention is that the respective increased or reduced ink application is generated in the precalculated corrective halftone image by increased or reduced ink drop volumes of the adjacent printing nozzles. This is a requirement for a compensation by neighboring printing nozzles on which the method of the invention likewise relies. The inkjet printing machine thus needs to be capable of producing ink drops of different sizes. The number of different sizes that may be generated is not relevant to the method of the invention. However, two different sizes are a minimum. The more different drop sizes the printing machine may produce, the more accurate but also the more complicated the compensation becomes.

Other features which are considered as characteristic for the invention are set forth in the appended claims.

Although the invention is illustrated and described herein as embodied in a method for compensating for defective printing nozzles in inkjet printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The invention as such as well as further developments of the invention that are advantageous in structural and/or functional terms will be described in more detail below with reference to the associated drawing and based on at least one preferred exemplary embodiment.

DETAILED DESCRIPTION OF THE INVENTION

Figure 1:
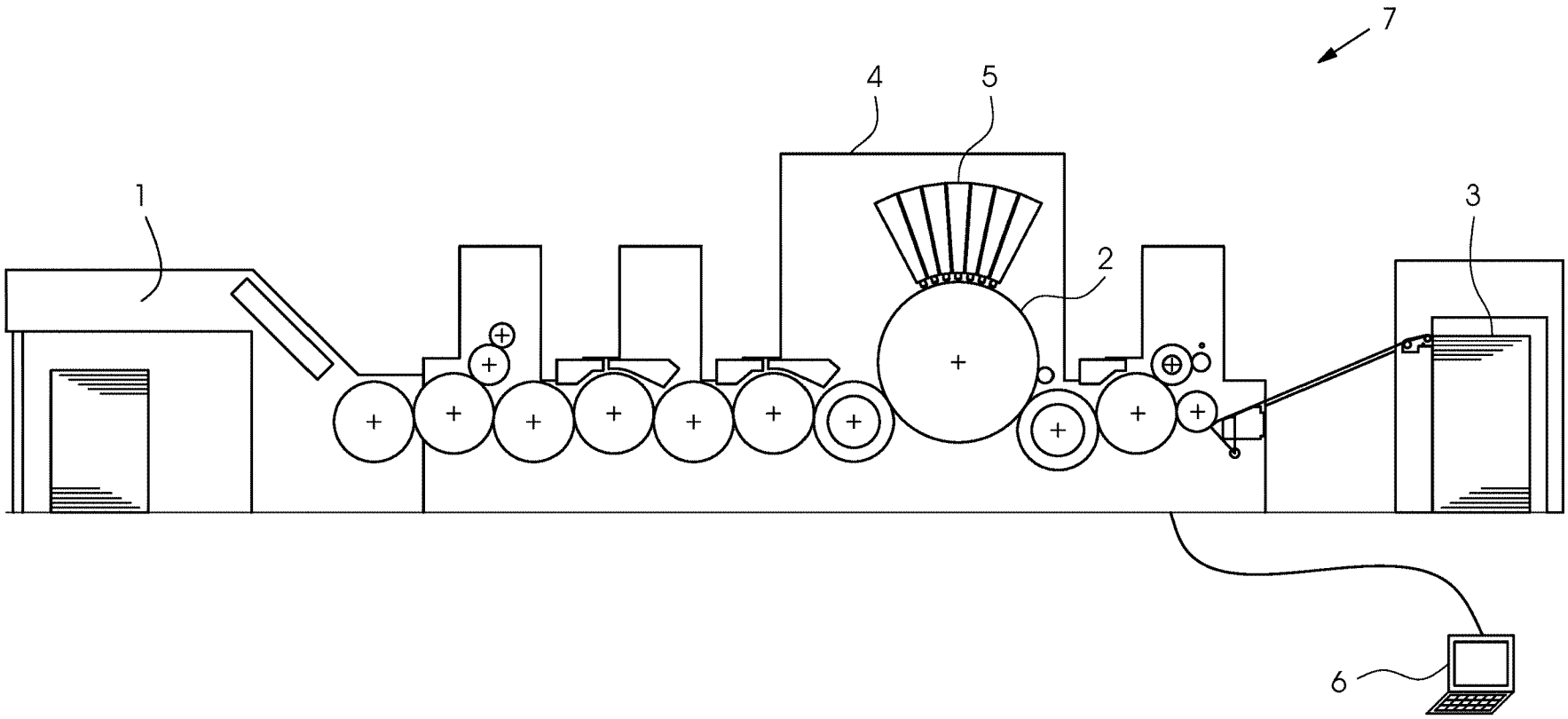
FIG. 1 is a diagrammatic, longitudinal-sectional view of an example of an inkjet printing machine.

Referring now in detail to the figures of the drawings, in which mutually corresponding elements have the same reference symbols, and first, particularly, to FIG. 1 thereof, it is seen that the field of application of the preferred embodiment is in an inkjet printing machine 7. FIG. 1 shows an example of the fundamental structure of such a machine 7, including a feeder 1 for feeding a printing substrate 2 to a printing unit 4, where it receives an image printed by print heads 5, and a delivery 3. The machine is a sheet-fed inkjet printing machine 7 controlled by a control unit 6. While this printing machine 7 is in operation, individual printing nozzles 8 in the print heads 5 in the printing unit 4 may fail as described above. Such a failure results in white lines 9 seen in FIG. 2 or, in the case of multicolor printing, in distorted color values.

Figure 2:
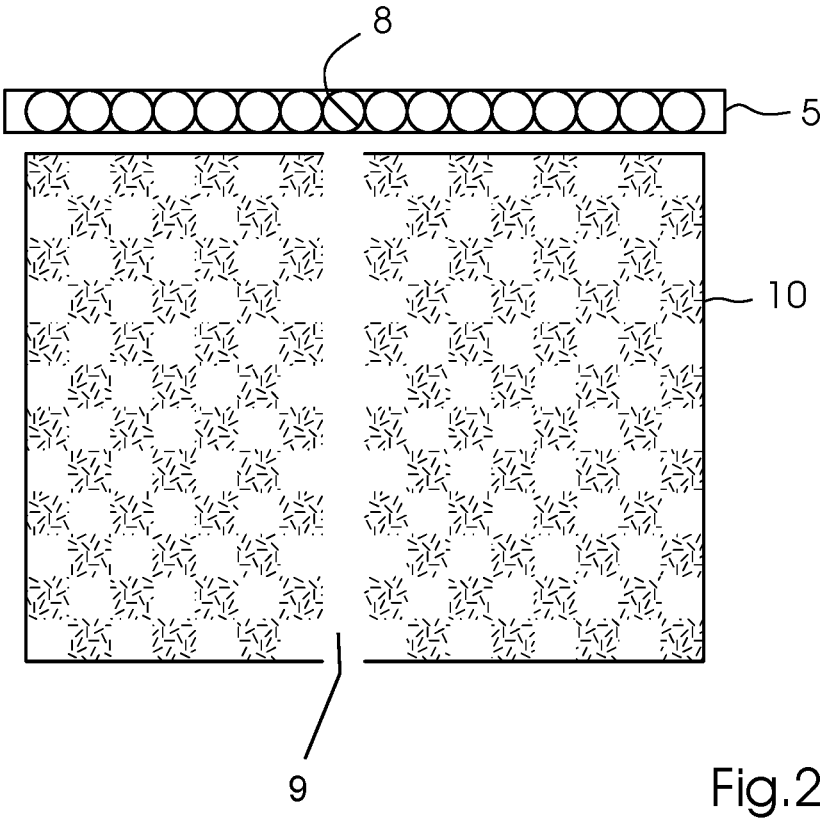
FIG. 2 is a top-plan view of a printing substrate having a halftone image with a defective printing nozzle.
Figure 3:
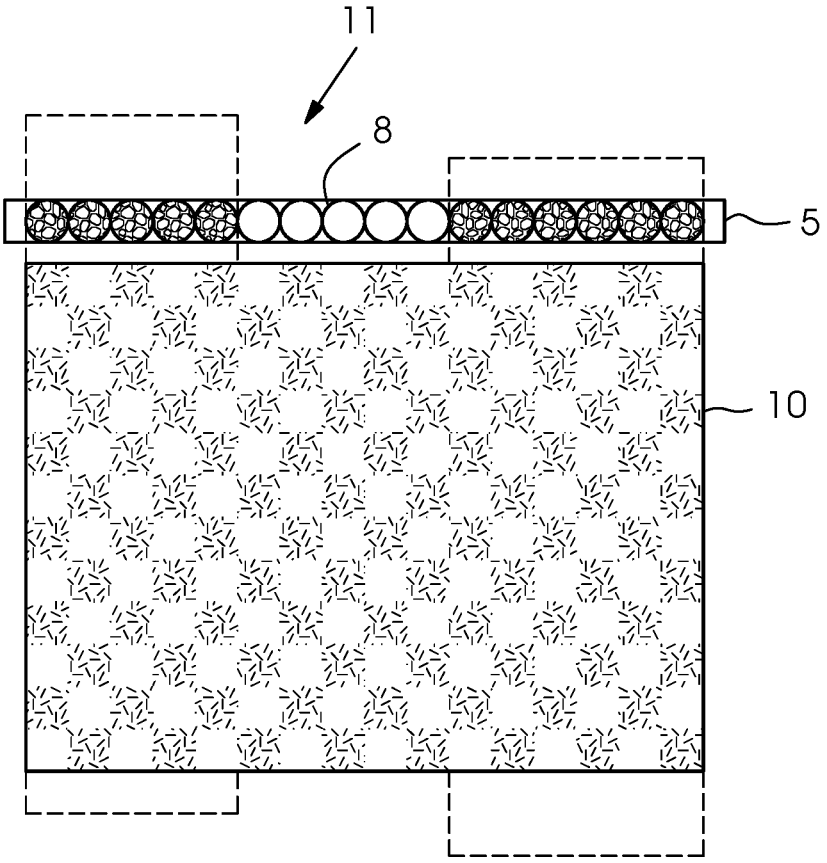
FIG. 3 is a top-plan view of a printing substrate having a correction width of five nozzles in the halftone.
Figure 4:
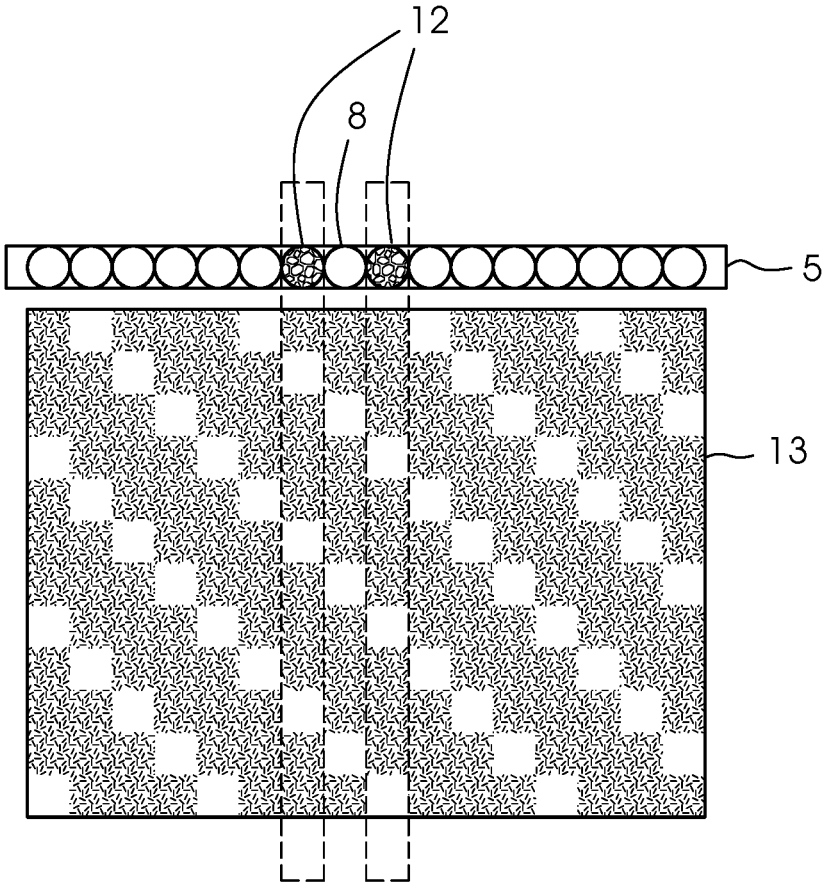
FIG. 4 is a top-plan view of a printing substrate having a first corrective halftone with increased ink application.

The preferred embodiment will be described below. FIG. 2 illustrates a halftone image 10 with a defective printing nozzle 8. It is clearly visible how the corresponding halftone dots in the corresponding printing direction are missing, resulting in a corresponding white line 9. The preferred exemplary embodiment uses a correction width 11 of five nozzles 5. This means that two columns 12 of adjacent printing nozzles disposed to the left and right of the defective printing nozzle 8 are used for compensation purposes. This is shown very clearly in FIG. 3. In order to compensate for the failed printing nozzle 8, the immediately neighboring printing nozzles in the columns 12 need to apply more ink. For this purpose, a different halftone 13 is used, which has been precalculated in accordance with the invention during the screening process at the preprint stage to avoid a re-screening of the print image when a defective nozzle 8 occurs. Another advantage of using a precalculated corrective halftone 13, 14 is that it may be adapted to the original image halftone 10. This prevents the occurrence of new artifacts in the print image due to a non-adapted corrective halftone that violates the screening rules. Such a corrective halftone 13 with increased ink application is shown by way of example in FIG. 4. In this case it is clearly shown how the increased ink application is achieved in accordance with the screening rules. For instance, at every location at which there was a pixel in the original halftone image 10, a pixel of the same or of a greater drop size is set in the first corrective halftone image 13. As is shown in FIG. 4, the first corrective halftone image 13 is exclusively used for the immediately neighboring printing nozzles 12 or rather the print columns 12 that are printed by these printing nozzles.

Figure 5:
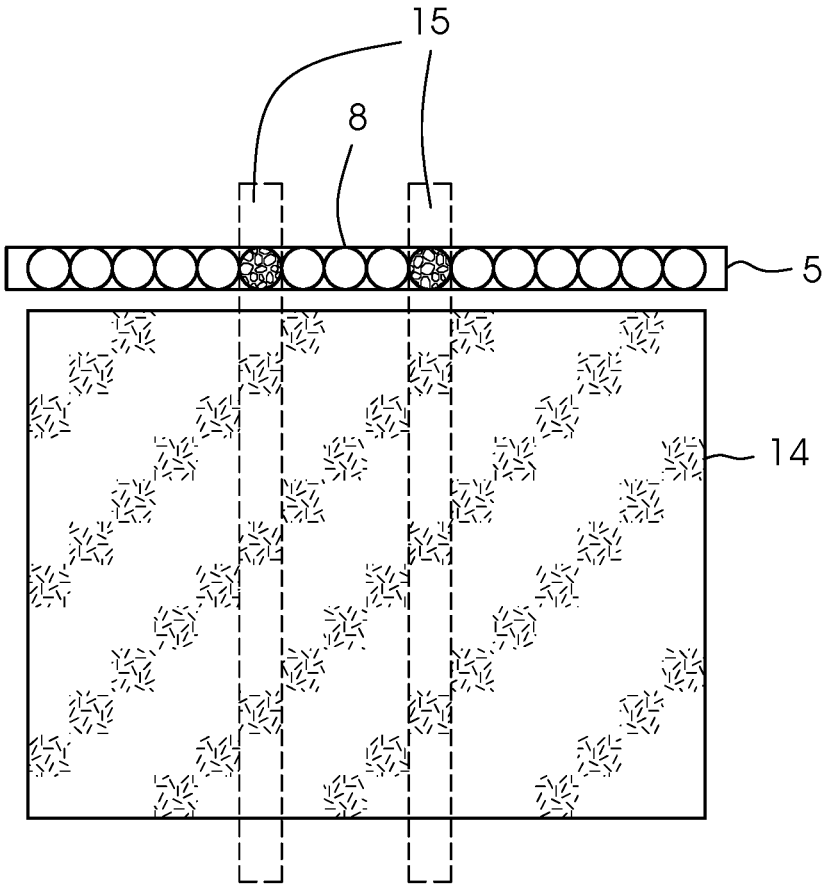
FIG. 5 is a top-plan view of a printing substrate having a second corrective halftone with decreased ink application.

In order to prevent overcompensation by increased ink application, a second corrective halftone 14 is used for the adjacent printing nozzles or rather print columns 15 that are correspondingly further away. This is shown in a corresponding way in FIG. 5. In this case, the screening rules are likewise respected. For instance, no dot that did not have a pixel in the original screen 10 has a pixel now. In addition, it is shown how the respective outer adjacent printing nozzles in the columns 15 in the applied correction width 11 of five use the corresponding corrective halftone image 14 with reduced ink application.

Figure 6:
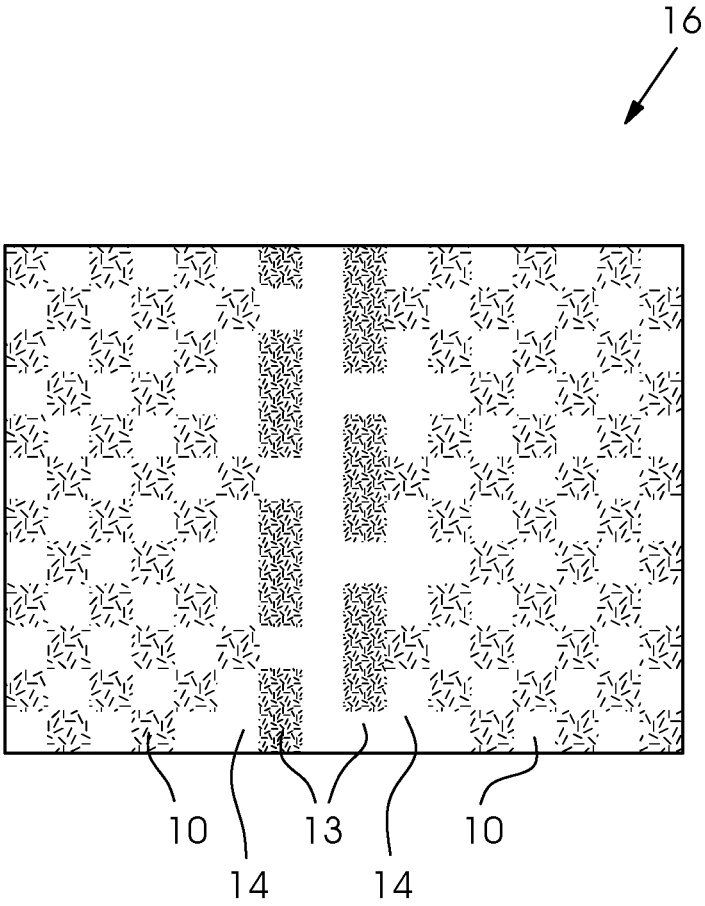
FIG. 6 is a top-plan view of a printing substrate having a corrected halftone image.

FIG. 6 shows the resultant corrected halftone image 16, which uses the original halftone 10 for the remainder of the print image. In order to correct the white line that has been created by the missing printing nozzle 8, the first precalculated corrective halftone 13 with increased ink application is used in the columns 12 immediately to the left and right of the missing printing nozzle 8. In order to avoid overcompensation, the second precalculated corrective halftone image 14 with decreased ink application is used at the respective outer locations of the columns 15 of the correction width 11.

Figure 7:
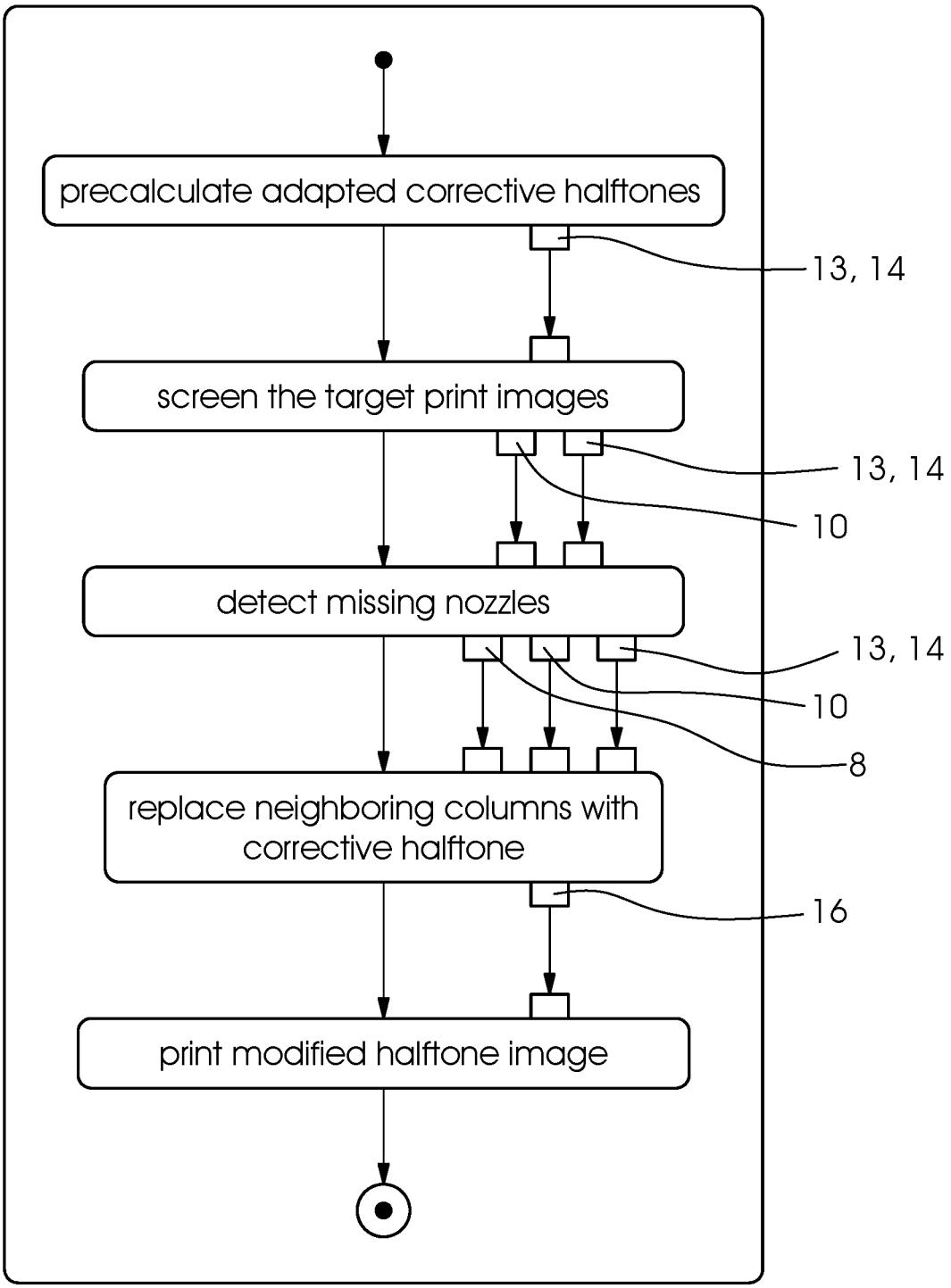
FIG. 7 is a flow chart of the method of the invention.

FIG. 7 is a flow chart of the method of the invention. The first step is to detect a missing nozzle 8. If the position thereof is known, the control unit 6 of the inkjet printing machine 7 may—in accordance with the preset, i.e. preconfigured correction width 11—insert the first and second corrective halftone images 13, 14 into the existing halftone image 10 that has already been screened. Then the printing operation is continued using this corrected halftone image 16 to compensate for the missing printing nozzle 8. For this purpose, in addition to the actual corrective algorithm for compensating for the missing printing nozzle 8, both the precalculated corrective halftone images 13, 14 and the corresponding correction width 11 to be applied need to be saved on the control unit 6 of the inkjet printing machine 7. Potential variations of the method of the invention, for instance in terms of the use of varying screens for the printing nozzles in the columns 12, 15 to the left and right including the specification when they need to be applied, must also be known on the control unit 6 by configuration. The precalculation of the corresponding corrective halftones 13, 14 preferably occurs at the same time as the screening of the actual print image. Thus, the precalculated corrective halftone images 13, 14 may be adapted to the corresponding print image. However, it is conceivable to use universal corrective halftone images that are independent of the print image to be produced. If this is the case, the latter need to be available in a memory that may be accessed by the control unit 6 of the inkjet printing machine. The precalculation of the corrective halftone images 13, 14 as well as the actual screening process may theoretically be carried out by the control unit of the inkjet printing machine itself. In general, however, this is done by a computer in the preprint department, also known as the raster image processor, and both the halftone print image 10 and the precalculated corrective halftone images 13, 14 are made available to the control unit 6 of the printing machine 7 by using a network or data memory.

The following is a summary list of reference numerals and the corresponding structure used in the above description of the invention:

1 feeder
2 printing substrate
3 delivery
4 inkjet printing unit
5 inkjet print head
6 computer
7 inkjet printing machine
8 defective printing nozzle
9 white line
10 original halftone
11 correction width
12 columns of immediately neighboring printing nozzles
13 first corrective halftone
14 second corrective halftone
15 columns of adjacent printing nozzles that are farther away
16 corrected halftone image

The invention claimed is:

1. A method for carrying out a printing operation on an inkjet printing machine while compensating for failed printing nozzles by using a computer, the method comprising the following steps:

after a screening process in which a halftone image is created for an image to be printed, compensating for failed printing nozzles by increased ink application from adjacent printing nozzles, by:

precalculating at least one corrective halftone image for the adjacent printing nozzles by using the computer;

replacing the halftone image created in the screening process with the corrective halftone image in at least one column of the adjacent printing nozzles;

replacing at least two columns of the adjacent printing nozzles both left and right of the failed printing nozzle in the halftone image as viewed in a printing direction with at least two different precalculated corrective halftone images; and carrying out the printing operation on the inkjet printing machine using the corrected halftone image.

2. The method according to claim 1, which further comprises both left and right of the failed printing nozzle as viewed in the printing direction:

using the at least one column immediately adjacent the failed printing nozzle to compensate for the failed printing nozzle by using at least one first corrective halftone image with increased ink application, and using the at least one column being farther away from the failed printing nozzle to prevent potential overcompensation by using at least one second corrective halftone image with reduced ink application.

3. The method according to claim 2, which further comprises generating the respective increased or reduced ink application in the precalculated corrective halftone image by increased or reduced ink drop volumes of the adjacent printing nozzles.

4. The method according to claim 1, which further comprises using respective precalculated corrective halftone images having been adapted in a suitable way for failed printing nozzles having a deviating print dot and for failed printing nozzles not printing at all or printing to a very reduced extent.

5. The method according to claim 1, which further comprises using columns respectively positioned left and right of the failed printing nozzle as viewed in a printing direction to carry out the compensation by using different precalculated corrective halftone images.

* * * * *